US009650819B2

(12) United States Patent
Bultschnieder et al.

(10) Patent No.: US 9,650,819 B2
(45) Date of Patent: May 16, 2017

(54) HINGE HOLDER FOR A STEEL DOOR FRAME

(71) Applicants: Andre Bultschnieder, Rheda-Wiedenbrueck (DE); Ulrich Pelz, Ennigerloh (DE)

(72) Inventors: Andre Bultschnieder, Rheda-Wiedenbrueck (DE); Ulrich Pelz, Ennigerloh (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 0 days.

(21) Appl. No.: 14/550,252

(22) Filed: Nov. 21, 2014

(65) Prior Publication Data

US 2015/0143754 A1 May 28, 2015

(30) Foreign Application Priority Data

Nov. 26, 2013 (DE) ..... 10 2013 113 056

(51) Int. Cl.

| | |
|---|---|
| ***E05D 7/04*** | (2006.01) |
| ***E05D 11/00*** | (2006.01) |
| ***E05D 15/00*** | (2006.01) |
| ***E06B 1/12*** | (2006.01) |
| ***E06B 1/52*** | (2006.01) |

(52) U.S. Cl.

CPC ..... *E05D 7/0423* (2013.01); *E05D 7/04* (2013.01); *E05D 11/00* (2013.01); *E05D 15/00* (2013.01); *E06B 1/12* (2013.01); *E06B 1/52* (2013.01); *E05D 2007/0476* (2013.01); *E05Y 2600/53* (2013.01)

(58) Field of Classification Search

CPC ..... Y10T 16/554; Y10T 16/5322; Y10T 16/53225; E05D 7/0423; E05D 7/04; E05D 2007/0476

See application file for complete search history.

(56) References Cited

U.S. PATENT DOCUMENTS 923,250 A * 6/1909 Davis ..... E05D 7/0423 16/246
5,075,928 A * 12/1991 Bobrowski ..... E05D 5/06 16/273

(Continued)

FOREIGN PATENT DOCUMENTS

| | | | |
|---|---|---|---|
| CA | 2 521 976 | * | 4/2006 |
| DE | 19930448 A | | 1/2001 |
| DE | 10 2009 017 029 | * | 8/2010 |

*Primary Examiner* — Gregory Strimbu
(74) *Attorney, Agent, or Firm* — Andrew Wilford

(57) ABSTRACT

A holder for securing a leaf of a hinge to a steel door frame has a first U-shaped housing part having two end walls, a bight wall connecting the two end walls, and respective mounting flanges projecting from the end walls and securable to the door frame. A complementarily second housing part defines a cavity with the first housing part and has a cover plate, a pair of end plates having outer faces bearing on inner faces of the end walls, and a front plate extending between the end plates and from a front edge of the cover plate and formed with a cutout through which a hinge leaf can extend into the cavity. A clamp in the cavity can secure the hinge leaf to the housing parts. There is a snap connection between the front plate and the first housing part.

13 Claims, 4 Drawing Sheets

(56) References Cited

U.S. PATENT DOCUMENTS

| | | | | |
|---|---|---|---|---|
| 5,193,308 | A * | 3/1993 | Davidian | E05D 5/023 16/257 |
| 2009/0057303 | A1 * | 3/2009 | Oddsen | H02G 3/14 220/3.5 |

* cited by examiner 1
7
25
5
15
16b
21
23
4
6
25
21
15
5
16b
7
8
3
32
17
32
18
20
20
2
26
10
24
16a
14
22
19
12
11
16a
14
10
9
22

HINGE HOLDER FOR A STEEL DOOR FRAME

FIELD OF THE INVENTION

The present invention relates to a holder for mounting a hinge to a steel door frame.

BACKGROUND OF THE INVENTION

A holder for securing a door hinge to a steel door frame has a first housing part of U-section and formed by two end walls and one bight wall connecting the two end walls and a connecting flange projecting from each end wall. The holder also comprises a second housing part that defines a cavity with the first housing part and that has a cover plate mounted opposite the bight wall. A clamp in the cavity for securing a hinge leaf of a door hinge inserted into the cavity is held between the bight wall and the cover plate. Two end plates projecting from the cover plate have outer faces adjacent the inner faces of the end walls, with a front plate extending from the front edge of the cover plate and having a cutout for inserting the hinge leaf into the holder.

Such a holder is known from DE 199 30 448 and is produced and distributed by the applicant, for example, under the classification Variant VX7611 3D. The holder is attached on the inside of a steel door frame using the connecting flanges such that the cover plate bears against the inside of the steel door frame. In this manner, the second housing part is held against the sheet-shaped support.

In this case, it is disadvantageous that such a holder can be subjected to only a limited amount of load. In the case of particularly heavy doors such as, for example, fireproof or hospital doors, this type of first housing part is not sufficient. The holder is no longer able to be securely held together by connection to the steel door frame.

OBJECTS OF THE INVENTION

It is therefore an object of the present invention to provide an improved hinge holder for a steel door frame.

Another object is the provision of such an improved hinge holder for a steel door frame that overcomes the above-given disadvantages, in particular that uses simple means to improve the load-bearing capacity of the holder without such an improvement hindering the pre-installation or installation process.

SUMMARY OF THE INVENTION

A holder for securing a leaf of hinge to a steel door frame has according to the invention a first U-shaped housing part having two end walls, a bight wall connecting the two end walls, and respective mounting flanges projecting from the end walls and securable to the door frame. A second housing part defines a cavity with the first housing part and has a cover plate parallel to and spaced from the bight wall, a pair of end plates projecting from upper and lower ends of the bight wall toward the bight wall and having outer faces bearing on inner faces of the end walls, and a front plate extending between the end plates from a front edge of the cover plate and formed with a cutout through which a hinge leaf can engage into the cavity. A clamp in the cavity can secure the hinge leaf extending through the cutout into the cavity. The clamp is supported on the bight wall and the cover plate. There is a snap connection between the front plate and the first housing part.

Such a snap connection does not incur any additional expense during the pre-installation stage because it can be locked on simply by fitting the second housing part in the first housing part. Here, the snap connection is aligned in such a way that it prevents the first and second housing parts from being pulled apart. Because relative movements in all other directions are already being prevented by the interfitting U-shapes of the two parts, the second housing part is securely locked in all movement directions by the snap connection according to the invention.

Preferably, the front plate comprises at least one barb that engages in a respective notch disposed on one of the end walls, thus forming the snap connection. The barb and/or the sheet surrounding the notch may be equipped with an insertion bevel that simplifies the insertion of the second housing part into the support. The barb and the notch can be produced during the production process from the sheet metal material using simple means.

In a preferred embodiment, the first housing part comprises a back wall extending perpendicular to the end walls of the U-shape. Here, the end plates of the second housing part engage against the front face of the back wall with their rear edges. This results in additional guidance.

A back plate is preferably bent back from the rear edge of the cover plate, engages behind the back wall and bears against the back face thereof. Such an embodiment guarantees the secure guidance and mounting of the second housing part on the support. Due to this mounting, the second housing part is movable only with one degree of freedom; this movement can be eliminated by the snap connection according to the invention.

It is advantageous for the back plate to cover more than 50%, in particular more than 75%, of the back face of the back wall. This causes the back plate and the back wall to share a particularly large contact surface that guarantees secure support.

In a particularly preferred embodiment, the back plate and the back wall are attached to one another by at least one snap connection. To this end, for example, locking elements may be formed from sheet metal tabs that are punched out of the sheet metal and bent back at a slight angle. In this manner, the surface of the tab forms a continually rising inclined contact surface and the punched-out edge forms a counter bearing for the snap connection. Such a sheet-metal tab is able to cooperate with a respective slot or window in the corresponding part. When snapped together, the edge of the sheet-metal tongue rests against the inner edge of the window or slot.

It is preferable for at least one snap connection between the back plate and the back wall to be flush with the clamp on the first housing part and the second housing part.

It is advantageous for the clamp to be adjustable in at least one direction. This allows the position of the hinge leaf held in the holder to be adjusted according to requirements, for example, the position and/or the contact pressure of the door leaf may be set.

Preferably, the clamp is movable in a straight line using parallel horizontal adjusting spindles. Adjusting spindles represent a self-securing linear adjustment drive that is particularly simple from a mechanical standpoint.

In a particularly preferred embodiment, the adjusting spindles are journaled on projections of the bight wall. In this manner, additional bores and/or parts for rotation are omitted, further simplifying the production process and reducing production costs. Front ends of the spindles fit in complementary circular bores in the cover plate.

It is advantageous for the connecting flanges to have weld bumps. These weld bumps act as defined contact points during joint welding to the steel door frame, thus simplifying arc welding.

In order to further stabilize the first and second housing parts, a preferred embodiment teaches that the end walls and the end plates are connected to each other by at least one snap connection. The snap connection may, for example, be formed by a ramp-shaped locking nose stamped into the sheet metal and a respective locking window. This additional snap connection on the narrow sides of the holder is particularly stable because the U-shaped first housing part attached by the connecting flange is no longer able to be pushed apart when installed. It is advantageous for the snap connections to be level with the rotation axes of the adjusting spindles. In the case of a snap connection with a locking window in the end plate, installation may be simplified by additionally providing a cutout having the width of the locking window on the side of the end plate facing away from the front plate. A strip remains between the cutout and the locking window such that the stability of the end plate is not affected. During installation, the second housing part may be positioned with the cutout on the associated locking tab of the outer leg. Any subsequent pressure load pushes the locking tab into the locking window, thus creating the snap connection.

It is advantageous for the first and/or the second housing part to be made from a weldable metal sheet. The shapes described in the embodiments may particularly be produced by cutting and bending operations on a metal sheet. The holder produced in this manner has a consistent wall thickness. The elements of the snap connections according to the invention may be formed by local deformation and cutting.

In a preferred embodiment, a front wall is folded from the front edge of the bight wall. This front wall is advantageously bent toward the cavity by an angle of approximately 90°. In this manner, an additional stabilization of the U-shaped first housing part is achieved. Bending of the bight wall is thus hindered.

It is particularly preferable for the front wall to extend essentially over the entire length—at least over 95% of the length—of the bight wall. In order to create a consistent appearance, the front faces of the front wall and of the front plate of the second housing part form a flush end face.

It is advantageous for the front wall and the front plate to press against one another with their edges, thus providing additional support.

An additional aspect of the invention lies in the fact that a steel door frame is provided with at least one holder as described above. Due to the particularly stable holder, the steel door frame is suitable for bearing the weight of particularly heavy doors.

It is advantageous for the holder to be welded to the inner face of the steel door frame. However, other attachment methods may be used as well such as, for example, screwing or riveting, without implying a limitation.

It is preferable for the second housing part to be fixed between the steel door frame and the first housing part welded thereto. In this manner, the load exerted by a door leaf held in the holder is not borne only by the snap connection or the cooperation between the steel door frame and the support, but rather is distributed evenly.

It is particularly preferable for the fastening means and/or the adjusting spindles of the holder to be accessible through holes in the steel door frame. In this manner, a door hinge held in the holder may be adjusted and/or removed even subsequently.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
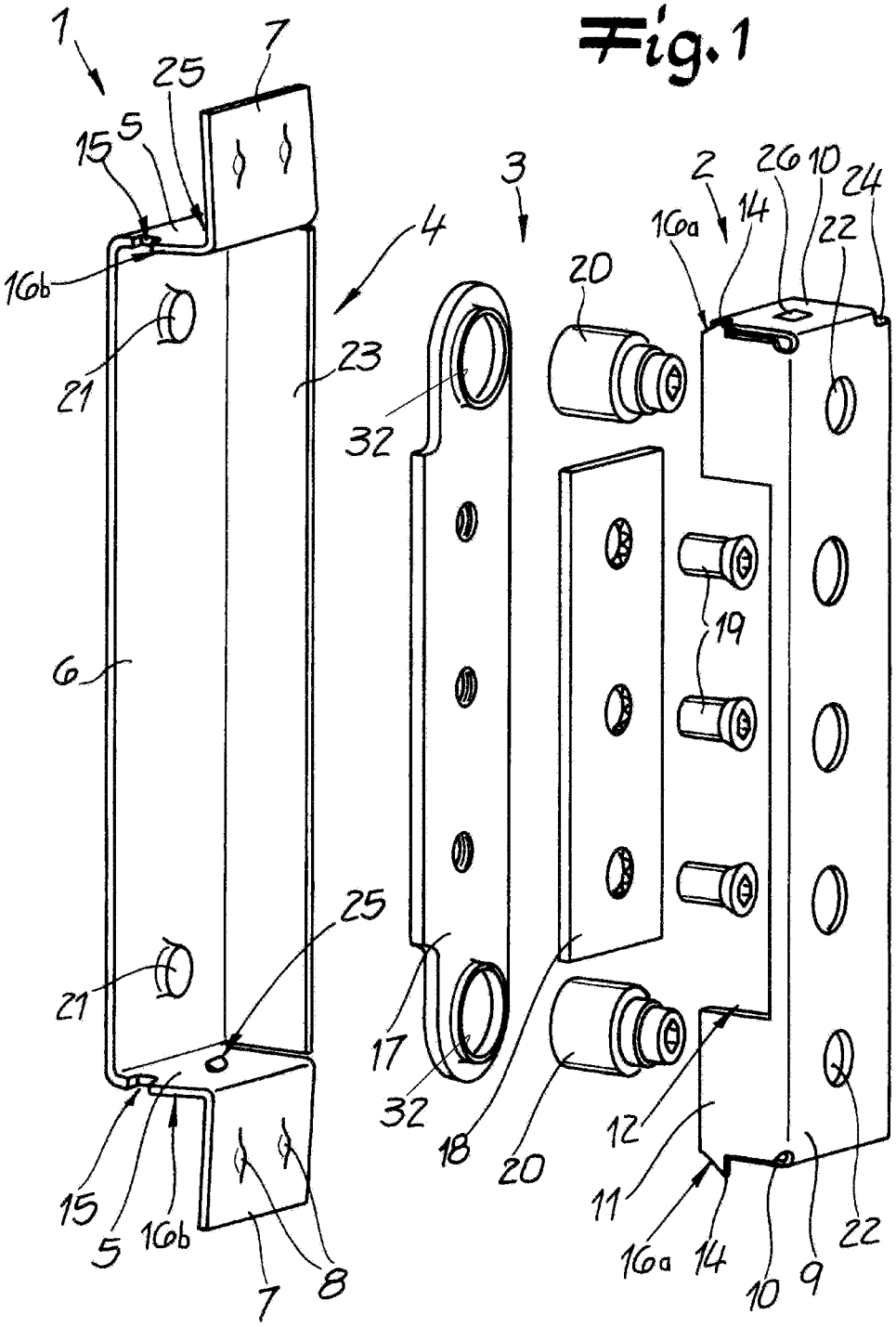
FIG. 1 is an exploded front perspective view of the holder according to the invention.

As seen in FIG. 1 a holder according to the invention comprises a first housing part 1 formed from sheet metal as well as a second housing part 2 also formed from sheet metal. The first and second housing parts 1 and 2 together define a cavity 4 that can hold the components of a clamp 3. The first housing part 1 is of U-shape and is formed by two planar, horizontal, and parallel end walls 5 and a planar vertical bight wall 6 connecting the two end walls 5. Coplanar vertical connecting flanges 7 project from the ends of the end walls 5 opposite the bight wall 6. The connecting flanges 7 are essentially parallel to the bight wall 6 and, in this embodiment, have weld bumps 8 for the fastening to a steel door frame.

Figure 2:
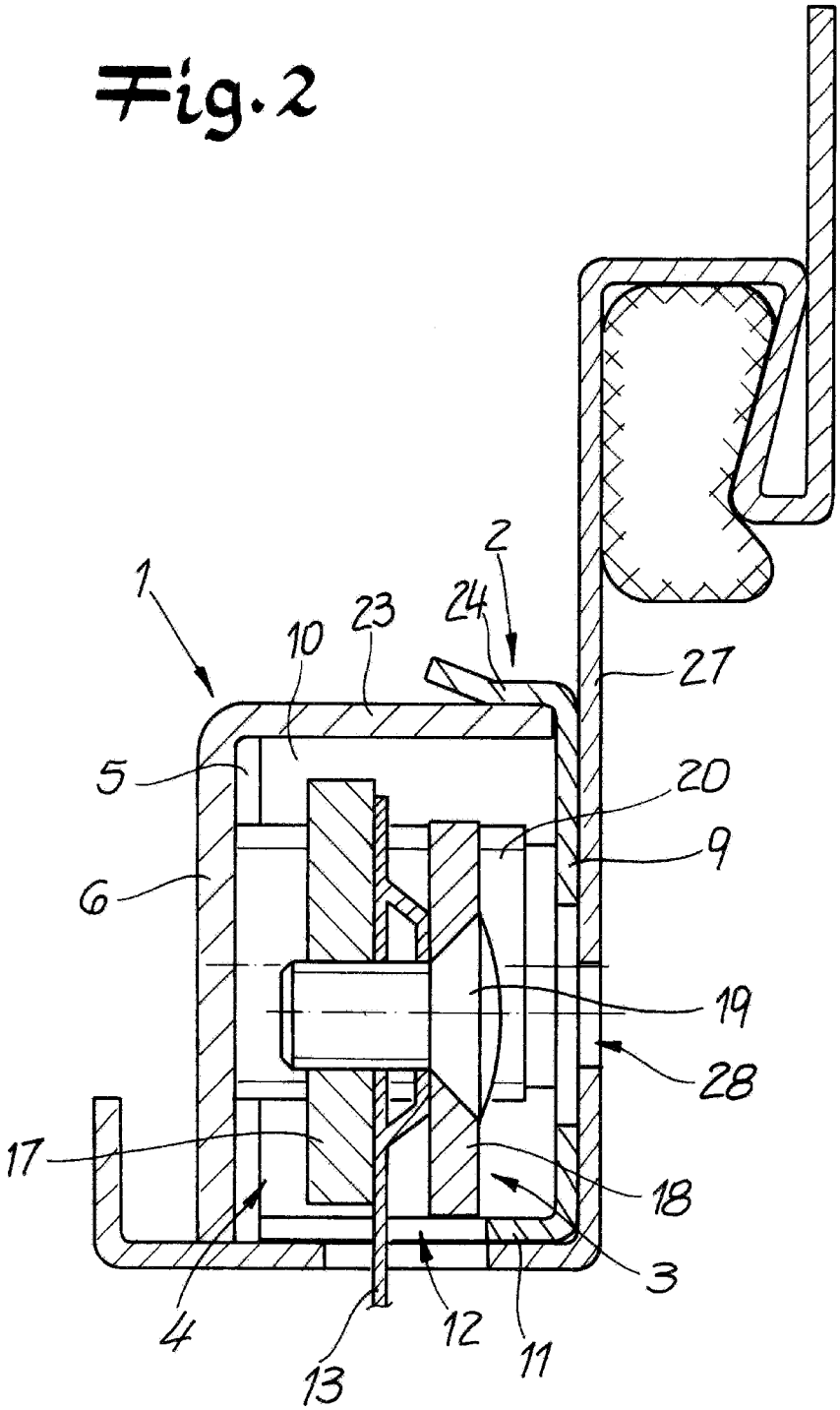
FIG. 2 is a horizontal section through the holder according to the invention installed in a steel door frame with its front side downward.

The second housing part 2 comprises a vertical and planar cover plate 9 that, in the mounted state closes the cavity 4 and extends essentially parallel to the bight wall 6. FIG. 2 shows that two horizontal and planar end plates 10 projecting from the cover plate 9 bear with their outer faces against inner faces of the end walls 5. A front plate 11 having a cutout 12 for insertion of a hinge leaf 13 into the cavity 4 for anchoring of the hinge leaf by the holder extends at a right angle from the front edge of the cover plate 9.

According to the invention, the front plate 11 is attached to the first housing part 1 by a snap connection. To this end, the front plate 11 comprises two barbs 14 that each engage in a notch 15 on the respective end wall 5. In order to facilitate assembly of the first housing part 1 and the second housing part 2, the barbs 14 and the end walls 5 each have an insertion bevel 16*a*, 16*b*.

The clamp 3 serves to secure the hinge leaf 13 inserted into the cavity 4 and is supported on the bight wall 6 and the cover plate 9. The clamp 3 can grip the hinge leaf 13 between a guide plate 17 and a clamp plate 18 that can be brought together by three clamping screws 19 threaded into the guide plate 17.

In addition, the clamp 3 is mounted in the hinge holder so as to be displaceable in a straight line perpendicular to the leaf 13. To this end, the guide plate 17 is carried by two threaded and parallel adjusting spindles 20. The adjusting spindles 20 engage with end seats at their inner ends over projections 21 formed from the sheet metal of the bight wall 6. A reduced-diameter end opposite the seat is journaled in a respective hole 22 of the cover plate 9 and is formed with a hexagonal socket for receiving an adjusting tool. Thus, the adjusting spindles 20 are rotationally supported at both ends and held securely between the first housing part 1 and the second housing part 2. A large-diameter central part of each spindle 20 is threaded into a complementary threaded bore 32 of the guide plate 17.

Moreover, the first housing part 1 has a back wall 23 extending perpendicular to the bight wall 6 and the end walls 5 forming the U-shape. When assembled, the end plates 10 of the second housing part 2 engage via their rear edges with the front face of the back wall 23. A bent-over back plate 24 on the rear edge of the cover plate 9 engages behind the back wall 23 and bears against its rear face. The back plate 24 is bent back on its outer end in order to simplify insertion of the back wall 23 of the first housing part 1 between the back plate 24 and the end plates 10. In FIGS. 1 and 2, the back plate overlaps the back wall 23 only to a small degree. In the variant shown in FIGS. 3 and 4, the back plate extends almost over the entire width of the back wall 23.

Figure 3:
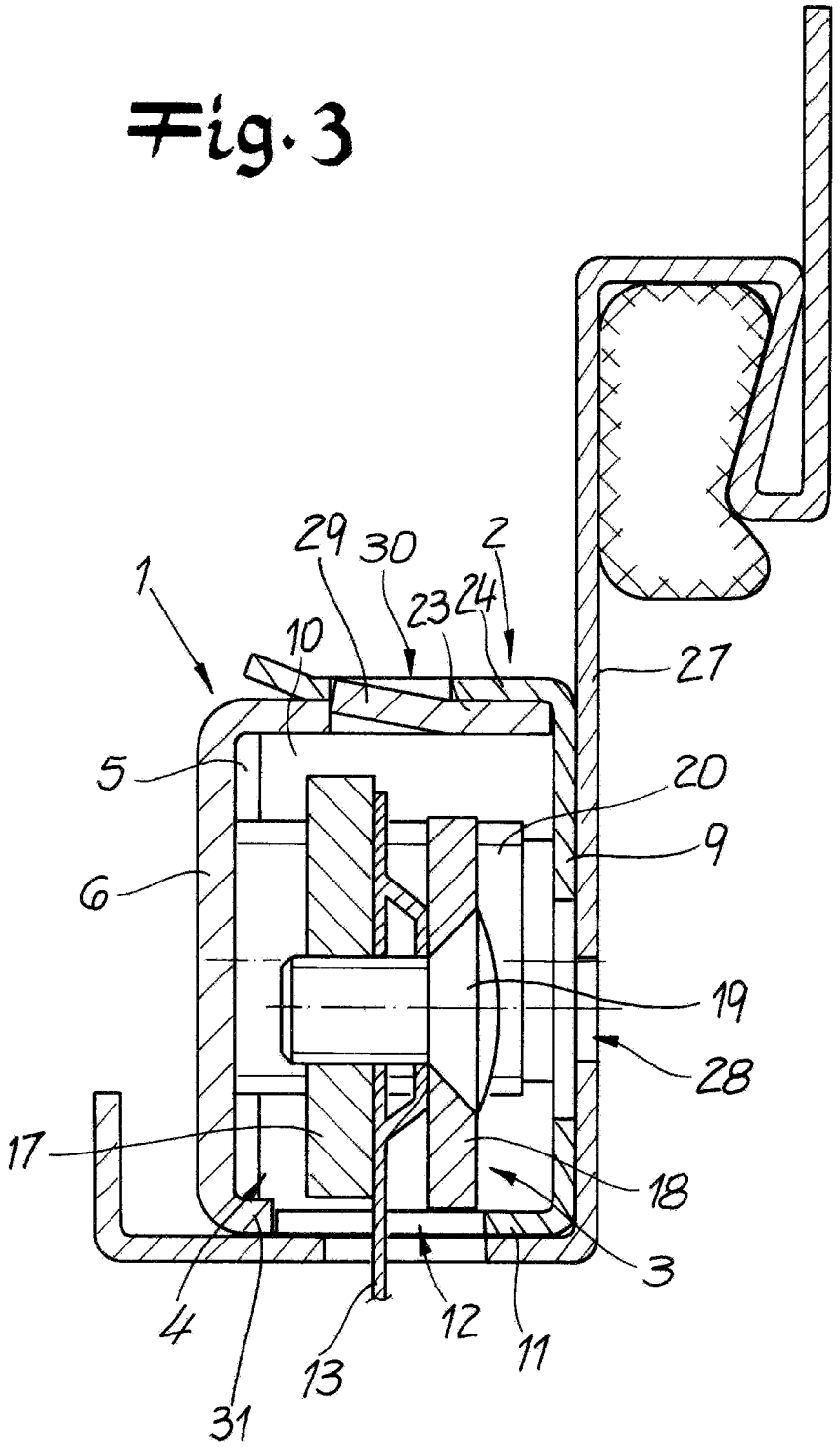
FIG. 3 is a horizontal section like FIG. 2 through the installed holder according to the invention.

In the embodiment according to FIG. 3, the snap connection is formed by a sheet-metal tongue 29 that is punched out of the sheet metal of the back wall 23 and is bent out at a slight angle. The sheet-metal tongue 29 cooperates with an aperture 30 of the back plate 24. A bent-in front wall 31 for stabilizing the U-shaped first housing part is provided opposite the back wall 23 on the front edge of the bight wall 6. The front face of the front wall 31 is flush with the front face of the front plate 11. The front wall 31 and the front plate 11 are flush with each other at their front faces and bear against each other, with the front wall 31 being very short and only bearing on the end parts of the front plate 11 flanking the cutout 12.

Ramp-shaped locking tabs 25 are provided on the end walls 5 and cooperate with respective locking windows 26 of the end plates 10. The locking tabs 25 are formed by local deformation of the end walls 5.

FIGS. 2 and 3 each show an installation situation. Here, the holder according to the invention is mounted inside a steel door frame 27. The first housing part 1 is welded inside the steel door frame 27 by means of the welding bumps 8 of the mounting flanges 7. The second housing part 2 is thus clamped between the steel door frame 27 and the first housing part 1. Additional retention forces are generated by the snap connection according to the invention. The clamping screws 19 and the adjusting spindles 20 are accessible from outside through the holes 28 in the steel door frame 27 and the cover plate 9.

Thus the parts 1 and 2 are U-shaped and open toward each other, with the part 1 closing the cavity 4 in the rear with the back wall 23 and the part 2 closing it toward the front with the front plate 11 except at the cutout 12. Both end plates 10 of the second part 2 fit inside the U of the first part 1. These end plates 10 bear rearward on the back wall 23 and the entire housing formed by the parts 1 and 2 is fitted as shown in FIGS. 2 and 3 in a corner of the frame and welded in place so the parts 1 and 2 are solidly locked together.

Figure 4:
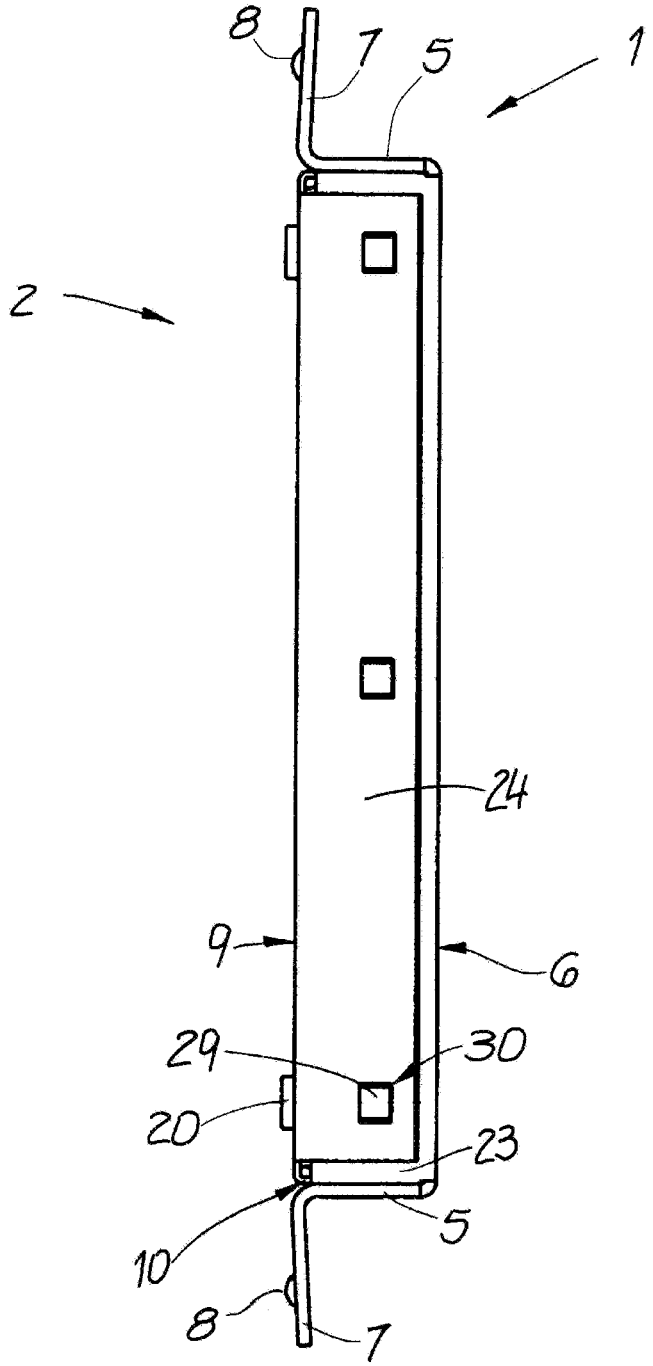
FIG. 4 is a rear view of the holder shown in FIG. 3.

FIG. 4 shows the rear side of the holder in the embodiment according to FIG. 3. The back plate 24 covers the back face of the back wall 23 almost completely. The back plate 24 is formed with the latch apertures 30 in which associated sheet-metal tongues 29 engage. Two of these snap connections 29, 30 are disposed so as to be flush with the rotation axis of the adjusting spindles 20.

In the embodiment according to FIGS. 3 and 4, latching occurs on all four sides of the cavity 4.

We claim:

1. A holder for securing a leaf of a hinge to a steel door frame, the holder comprising:

a first U-shaped housing part having a bight wall having upper and lower ends, upper and lower end walls extending from the upper and lower ends of the bight wall, one of the end walls including a notch disposed adjacent the bight wall, and mounting flanges projecting from the end walls and securable to the door frame;

a second housing part defining a cavity with the first housing part and having a cover plate parallel to and spaced from the bight wall and having upper and lower ends, respective upper and lower end plates projecting from the upper and lower ends of the cover plate toward the bight wall and having outer faces bearing on inner faces of the end walls, a front plate extending between the end plates and from a front edge of the cover plate and formed with a cutout through which the hinge leaf can extend into the cavity, and a barb on the front plate, the barb including an insertion bevel engageable in the notch, and the barb and the notch forming a snap connection which connects the front plate and the first housing part; and a clamp disposed in the cavity and securing the hinge leaf extending through the cutout into the cavity to the first and second housing parts, the clamp being supported by the bight wall and the cover plate.

2. The holder defined in claim 1, wherein the clamp is adjustable in at least one direction.

3. The holder defined in claim 2, further comprising:

adjusting spindles journaled on the bight wall and in the cover plate and threaded to the clamp.

4. The holder defined in claim 3, wherein the adjusting spindles are rotationally mounted on respective projections of the bight wall.

5. The holder defined in claim 1, wherein the mounting flanges have weld bumps.

6. The holder defined in claim 1, wherein the clamp comprises moveable plates.

7. The holder defined in claim 1, wherein the end walls and the end plates are connected together with additional snap connections.

8. The holder defined in claim 1, wherein the first housing part and the second housing part are made of a weldable metal sheet.

9. The holder defined in claim 1, wherein the flanges are welded to an inner face of the steel door frame.

10. The holder defined in claim 9, wherein the second housing part is clamped between the steel door frame and the first housing part.

11. The holder defined in claim 1, further comprising:

adjusting spindles journaled on the bight wall and in the cover plate and threaded to the clamp, the frame including holes through which the spindles are accessible.

12. A holder for securing a leaf of a hinge to a steel door frame, the holder comprising:

a first U-shaped housing part having a bight wall having upper and lower ends, upper and lower end walls extending from the upper and lower ends and each including a notch adjacent the bight wall, and mounting flanges projecting from the end walls and securable to the door frame;

a second housing part defining a cavity with the first housing part and having a cover plate parallel to and spaced from the bight wall, a pair of end plates projecting from upper and lower ends of the cover plate toward the bight wall and having outer faces bearing on inner faces of the end walls, and a front plate extending between the end plates and from a front edge of the cover plate, including a cutout through which the hinge leaf can project into the cavity, and including upper and lower edges;

upper and lower barbs each formed on and projecting from a respective one of the upper and lower edges of the front plate, each said barb being formed with an insertion bevel and being engageable in a respective one of the notches to form therewith a snap connection between the front plate and the first housing part;

a clamp disposed in the cavity, the clamp securing the hinge leaf extending through the cutout into the cavity to the first and second housing parts, the clamp being supported by the bight wall and the cover plate.

13. The holder defined in claim 12, wherein the first housing part has a sheet-metal back wall extending perpendicular to the end walls and parallel to the front plate, and the second housing part has a back plate engaging a rear face of the back wall.

* * * * *